US011154112B2

(12) United States Patent
Bäumer

(10) Patent No.: US 11,154,112 B2
(45) Date of Patent: Oct. 26, 2021

(54) ORTHOPAEDIC FOOT BED AND METHOD FOR PRODUCING AN ORTHOPAEDIC FOOT BED

(71) Applicant: Christoph Bäumer, Hamburg (DE)

(72) Inventor: Christoph Bäumer, Hamburg (DE)

( * ) Notice: Subject to any disclaimer, the term of this patent is extended or adjusted under 35 U.S.C. 154(b) by 106 days.

(21) Appl. No.: 16/482,606

(22) PCT Filed: Jan. 23, 2018

(86) PCT No.: PCT/EP2018/051569
§ 371 (c)(1),
(2) Date: Jul. 31, 2019

(87) PCT Pub. No.: WO2018/145892
PCT Pub. Date: Aug. 16, 2018

(65) Prior Publication Data

US 2020/0245713 A1 Aug. 6, 2020

(30) Foreign Application Priority Data

Feb. 7, 2017 (DE) ..... 102017201885.2

(51) Int. Cl.
*A43B 7/14* (2006.01)

(52) U.S. Cl.
CPC ..... *A43B 7/146* (2013.01); *A43B 7/144* (2013.01); *A43B 7/1465* (2013.01)

(58) Field of Classification Search
CPC ..... A43B 7/146; A43B 7/1465; A43B 7/144
(Continued)

(56) References Cited

U.S. PATENT DOCUMENTS 4,047,310 A * 9/1977 Sunoo ..... A43B 3/128 36/11.5
4,760,651 A * 8/1988 Pon-Tzu ..... A43B 7/06 36/138

(Continued)

FOREIGN PATENT DOCUMENTS

CH 702 144 A2 12/1978
DE 44 06 063 A1 8/1995

(Continued)

OTHER PUBLICATIONS

Lisa et al., "Souls Thongs: Flip Flops mit Massagenoppen für mehr Wohlgefühl beim Laufen" COVERtrends Aug. 3, 2015.

(Continued)

*Primary Examiner* — Marie D Bays
(74) *Attorney, Agent, or Firm* — Saliwanchik, Lloyd & Eisenschenk

(57) ABSTRACT

Orthopaedic foot bed for a shoe with a foot support surface, wherein the foot support surface is formed by a plane base surface. The foot bed has a multiplicity of knobs which are distributed in a predefined manner and by which the stimulation points in the sole are stimulated in a targeted manner, as a result of which the neurological, biotensegrity and liquid-dynamic system of the human body can in turn be improved. Through the improvement thereby achieved, it is possible to address and improve certain aspects of human health, which in particular include the gait pattern and posture of the human body. Moreover, by means of the invention, the transport of the lymphatic and venous liquids ("heart of feet function" of the sole) can be excited and intensified.

18 Claims, 9 Drawing Sheets

Figure 1:
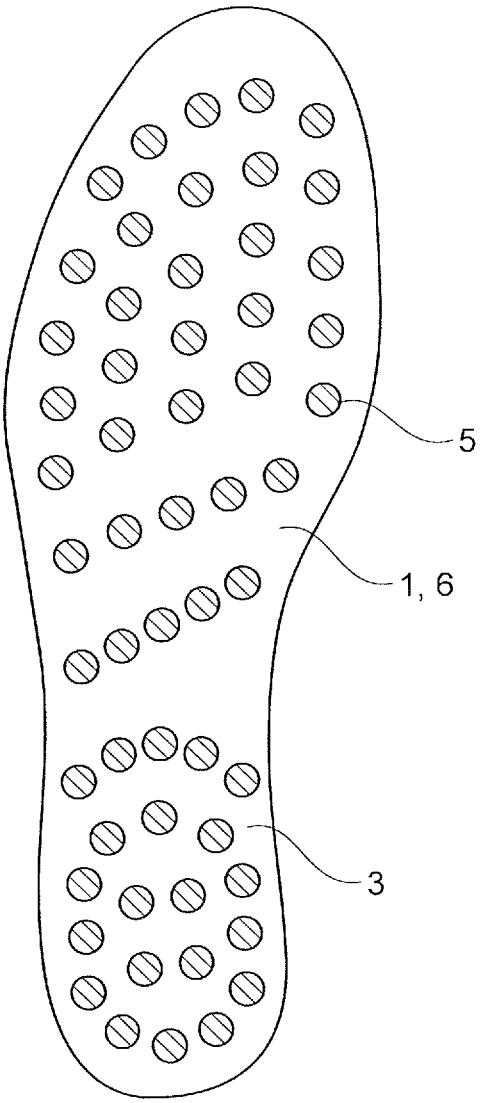

(58) Field of Classification Search
USPC ..... 36/141
See application file for complete search history.

(56) References Cited

U.S. PATENT DOCUMENTS

| | | | | | |
|---|---|---|---|---|---|
| 4,841,648 | A * | 6/1989 | Shaffer | A43B 7/1465 | 36/145 |
| 4,862,604 | A * | 9/1989 | Hauser | A43B 7/141 | 36/43 |
| 4,955,148 | A * | 9/1990 | Padilla | A43B 7/141 | 36/174 |
| 5,322,056 | A * | 6/1994 | Menghi | A43B 7/141 | 36/11.5 |
| 5,400,526 | A * | 3/1995 | Sessa | A43B 1/0045 | 36/141 |
| 5,860,229 | A * | 1/1999 | Morgenstern | A43B 13/14 | 36/141 |
| 5,894,687 | A | 4/1999 | Lin | | |
| 6,510,626 | B1 | 1/2003 | Greenawalt | | |
| 6,715,221 | B1 * | 4/2004 | Sasaki | A43B 1/0045 | 36/141 |
| 7,062,866 | B2 * | 6/2006 | Bussler | A43B 7/142 | 36/102 |
| 9,918,512 | B2 * | 3/2018 | Lazarchik | A43B 13/386 | |
| 10,188,172 | B1 * | 1/2019 | Wurtz | A43B 1/10 | |
| 2002/0049469 | A1 * | 4/2002 | Chang | A43B 7/146 | 606/204 |
| 2004/0000076 | A1 * | 1/2004 | Celmo | A43B 17/00 | 36/141 |
| 2004/0103558 | A1 * | 6/2004 | Everz | A43B 7/1415 | 36/43 |
| 2005/0049533 | A1 | 3/2005 | Beiruti | | |
| 2012/0117702 | A1 * | 5/2012 | King | A41B 17/005 | 2/2.16 |
| 2013/0104419 | A1 | 5/2013 | Horesh et al. | | |
| 2017/0303635 | A1 * | 10/2017 | Kazarian | A43B 13/226 | |
| 2017/0340062 | A1 * | 11/2017 | Qin | A43B 17/006 | |
| 2019/0116922 | A1 * | 4/2019 | Wurtz | A43B 7/142 | |
| 2019/0142107 | A1 * | 5/2019 | Ferniani | A43B 7/1465 | 36/141 |
| 2020/0163413 | A1 * | 5/2020 | Cran | A43B 17/006 | |
| 2020/0178648 | A1 * | 6/2020 | Rini | A43B 7/149 | |
| 2020/0245713 | A1 * | 8/2020 | Baumer | A43B 7/146 | |

FOREIGN PATENT DOCUMENTS

| | | | | |
|---|---|---|---|---|
| DE | 296 16 911 | U1 | 12/1996 | |
| DE | 298 10 518 | U1 | 6/1998 | |
| DE | 10 2007 033 439 | A1 | 7/2007 | |
| EP | 0 037 462 | A1 | 10/1981 | |
| WO | WO 1998/012942 | A1 | 4/1998 | |
| WO | WO 1999/32004 | A1 | 7/1999 | |
| WO | WO 2003/063630 | A1 | 8/2003 | |
| WO | WO 2006/035469 | A2 | 4/2006 | |
| WO | WO 2012/046342 | A1 | 4/2012 | |
| WO | WO 2014/101883 | A1 | 7/2014 | |
| WO | WO-2016090926 | A1 * | 6/2016 | A43B 7/34 |

OTHER PUBLICATIONS

1st Examination Report issued by the German Patent and Trademark Office dated Oct. 5, 2017 with respect to priority German Patent Application No. 10 2017 201 885.2.

* cited by examiner

ORTHOPAEDIC FOOT BED AND METHOD FOR PRODUCING AN ORTHOPAEDIC FOOT BED

CROSS REFERENCE TO RELATED APPLICATIONS

This application is a National Stage Application of International Application Number PCT/EP2018/051569, filed Jan. 23, 2018; which claims priority to German Patent Application No. 10 2017 201 885.2, filed Feb. 7, 2017.

A problem of modern civilized societies is that the deformation of people's feet is increasing. The deformation of the feet can in turn cause postural defects, which can lead to significant health complaints in the long term. It has been found that at least 90% of all humans have healthy feet at birth, while at least 60% of all humans have structurally and/or functionally damaged feet as adults.

In primitive societies, in contrast, in which regular use of shoes is the exception, foot deformations are much rarer. Healthy feet are essentially maintained for longer.

The increased foot deformation in people in civilized societies results inter alia from walking on hard ground and from separation of the feet from their natural perception of the surroundings, which in particular leads to weakening of the feet. In this case, a distinction is made in principle between structural damage of the feet and functional damage of the feet. Structural damage is for example pes equinovarus and pes calcaneus, serious toe deformities such as Hallux valgus and hammer toe, i.e. damage to the foot itself. The proportion of structurally damaged feet has also increased in civilized societies, on account of the problems described above. A functional disorder of the foot, in contrast, is understood to be a dysfunction of the foot such as unhealthy rolling behaviour or impaired statics. In this case, impaired statics of this kind can in particular lead to bad posture of the person, as a result of which further muscular problems or joint or spinal problems may be caused. Examples for this are splayfoot and in particular also talipes valgus and pes planus. These disorders, too, have increased significantly.

Against this background, the object of the invention is that of providing an improved orthopaedic footbed by means of which the above-described problems can be solved in a cost-effective manner and as far as possible for the population as a whole. Furthermore, a cost-effective method for providing an orthopaedic footbed for the population as a whole is intended to be provided.

According to the basic concept of the invention, it is proposed, according to claim 1, that the foot contact surface of the footbed should be formed by a planar base surface having a plurality of pimples that are arranged in accordance with a distribution that is optimized for podiatry.

Commercially available shoes are generally provided with a footbed having a foot contact surface, the foot contact surface being purposely adapted to the foot shape. In particular, the foot contact surface is raised in the region of the foot arch, for example by what is known as a truss pad, such that said foot arch is supported, in particular irrespective of whether or not the foot has a structural and/or functional disorder. This causes the load on the foot to be reduced, with the result that the strength and shape of the foot can in turn be permanently weakened.

The invention takes an entirely different approach in comparison. Specifically, according to the invention the foot contact surface of the footbed is formed by a planar base surface, the foot thus rests on a deliberately planar foot contact surface, and is thus deliberately stressed and loaded, such that the foot is strengthened by the regular loading, as a result of which, in turn, the likelihood of structural and/or functional disorders of the foot is reduced. In this case, the solution according to the invention follows the example of primitive societies where people walk barefoot and thus do not walk on a foot contact surface that is purposely adapted to the sole of the foot. The proposed orthopaedic footbed essentially makes it possible to combine shoes used in modern civilized societies with loading of the foot that approximates that of walking barefoot, by means of the planar base surface in the shoe. The proposed footbed is also referred to as a standard footbed. A base surface having slight unevenness, such as elevations, is also understood to be a planar base surface, which unevenness may be due to long use, uneven ground, or manufacturing inaccuracies.

It is furthermore proposed that the base surface should comprise a plurality of pimples which are arranged in a distribution that is optimized for podiatry. A distribution of this kind may for example be a distribution in accordance with the anatomical distribution, projected in the foot contact surface, of the bony parts, and/or the distribution, projected in the foot contact surface, of the pathways comprising the lymphs and/or the nerves and/or the vessels, of a human foot that is resting on the foot contact surface. As a result, the pimples purposely form stimulation points for the sole of the foot which are arranged in accordance with the bony parts and/or the pathways of the foot. Pathways are assigned to the bony parts, which pathways are similar, with minor variations, in all humans, and can be considered a universal basic arrangement resulting from evolution. The basic arrangement of the course of the pathways is thus a representation of the bony parts of the foot. The proposed arrangement of the pimples in accordance with the bony parts and/or the pathways deliberately stimulates the human biotensegrity system. In this case, the proposed distribution of the pimples is defined with respect to the bony parts and/or the pathways of a foot contact surface in a foot that comes into contact in a normal position or in a pre-determined orientation and position, such that the pimples on the foot contact surface are associated with pre-determined zones of the sole of the foot or of the bony parts and/or the pathways of a foot resting on the foot contact surface.

The biotensegrity system is an important scientifically accepted fundamental principle of the human body, and describes an underlying tension system or a self-regulating stabilizing system in the human body. The term "biotensegrity", or in general also "tensegrity" is a compound coinage of the words "tension" and "integrity". According to the principle of the tensegrity concept, the ligaments and fasciae correspond to fixed tensile ligaments in the medical field, while the bones correspond to the fixed thrust pieces of the model. These are supplemented by the dynamic stabilizers of the system, i.e. the muscles which impart the pretension of the system. The pretension generated by the muscles determines the reaction of the tensegrity system to loads that arise. Under biological loading and everyday conditions, the stability of the entire system depends on the dynamic stabilizers. The greater the pretension in the bond, the more stable the system. Too low a pretension results in the system giving way and in posture problems, while too great a pretension in turn causes restriction of mobility and other undesired medical after-effects such as tennis elbow and other instances of orthopaedic enthesitis or foot deformities such as pes cavus. In the case of a skeleton that is still growing, this incorrect organization of the forces leads to scoliosis, postural abnormalities, foot deformities and other anatomical states that develop adversely in later life. Since, in humans, muscle tension is lowered in sleep, in contrast with some animals, humans are unable to stand up when asleep. If the structure, e.g. the thrust parts, the geometry and the biomechanics, is impaired, this leads to the tensile parts no longer being able to be pretensioned by the dynamic tensioning means, formed by the muscles, in such a way as to form an inherently stable system. If a structural disorder, such as cerebral palsy, is present, this can often be remedied only by mechanistical measures or by means of an operation. In this case, the balancing and symmetry-defining pretension of the system is not provided, owing to central neurological damage, meaning that malalignments of the joints may result. If the dynamic tensile ligaments (tendons and fasciae) are too weak, such as in the case of a connective tissue disease, the healthy dynamic tensioning muscle likewise cannot pretension the biotensegrity system to a stable system. In both these cases of structural disorder, the proposed orthopaedic footbed is a compensation and training aid for the remaining function of the biotensegrity system that is present and can be developed. Complex treatment that is based on this understanding thus always also involves equalization of the tension in the dynamic portions of the system, i.e. the muscles in the human system. Humans themselves can generally achieve this by an improvement in the sensory system, in that the correct muscle tension is generated by means of matching to centrally stored target values, it being possible for the improvement in the sensory system to be further promoted by muscular stamina training and targeted relaxation and stretching of shortened structures, and strengthening of structures that are too weak. The proposed footbed helps in all aspects of this scientific basis.

The distribution of the pimples corresponds to the anatomical distribution of the bony parts or the pathways of the human foot, and thus also to the distribution of the sensory fields in the sole of the foot. In this case, they in particular follow the distribution of the bony parts in the heel, the tarsus and the transition region between the tarsus and the metatarsus, and in particular in the metatarsal tendon region. As a result, the stimulation points of the sole of the foot are stimulated in a specific manner and sequence in the case of the physiological rolling pattern of walking. The sequence of the stimulation leads to perception in the person's brain, which is coded in a particular manner and leads to reflex-based adjustment of posture and gait.

The human biotensegrity system further comprises a plurality of chambers in which individual cells up to entire organs are arranged in each case, in a scaled manner. In this case, irrespective of the size thereof, each chamber is subjected to pressure changes on account of the movement, muscle power and body weight. The cyclical movement of a person while walking results in a temporally coded pressure change in the foot, i.e. initially a pressure increase in the heel, then a pressure increase in the tarsus region, followed by a pressure increase from the metatarsus region as far as the toes, until the foot leaves the ground in order to prepare for the next step. This pressure wave which extends cyclically through the foot is the main pump for all the fluids of the foot, both venous and lymphatic. In contrast to human blood, which is pumped arterially from the heart to the foot, the lymphatic and venous fluid is not moved by the heart, but instead this function is essentially performed by the foot. Accordingly, the foot could also be understood as the heart or as a pump for the low-pressure system of the veins and the lymphatic vessels. This pump is activated or stimulated by the proposed distribution of the pimples, and the biotensegrity system is essentially strengthened thereby. This function can also be referred to as a "heart of feet function".

It is furthermore proposed that the pimples be arranged, in a zone of the foot contact surface on which a foot comes into contact by a front ball of the foot, in five rows, corresponding to the orientation of the bony parts that form the five toes and/or along the pathways assigned thereto. The pimples thus extend in five rows along the bone structures of the foot that form the toes and the metatarsus bones, proceeding from the metatarsus as far as the tips of the toes or the last bone member of the toes, and thus stimulate, in a targeted manner, the stimulation points arranged on the bony parts or the pathways of the toes. In this case it is assumed that the foot comes into contact with the footbed in the intended normal orientation, which necessarily results when the shoe is put on, when the footbed is arranged in the shoe. This applies in principle for the entire application, when the footbed is described with respect to a foot that is in contact therewith.

Furthermore, the pimples are preferably arranged in a circular manner in a zone of the foot contact surface on which a heel of a foot comes into contact. The pimples that are arranged in an imaginary circle cause the foot to be stimulated in a uniform manner, in the region of the heel, the arrangement of the pimples in the heel region more preferably being formed by a circle of pimples comprising further, uniformly distributed pimples that are arranged within the circle. This produces a specific stimulation effect which results in a specific movement vector.

It is furthermore proposed that the pimples be arranged, in a zone of the foot contact surface on which a midfoot region of a foot comes into contact, in at least two lines that diverge towards the inside of the foot contact surface. In this case, the inside of the foot contact surface is the side of the foot contact surface which is assigned to the inside of a foot resting thereon, the inside of the foot in turn being the side of the foot which is adjacent to the respective other foot of a person in normal standing posture of the person. In principle, the spacings of the stimulation points in the longitudinal direction of the sole of the foot increase from the outside of the foot to the inside, which is taken into account in the solution according to the invention by the pimples on the foot contact surface that are arranged in divergent lines.

It is furthermore proposed that the spacings between the pimples reduce, in the longitudinal direction of the foot contact surface, proceeding from a zone of the foot contact surface on which a midfoot region of a foot comes into contact, to a front and/or rear face of the foot contact surface. The pimple density on the foot contact surface thus increases from the midfoot to the front and rear side of the foot contact surface, resulting in particular in stimulation of the stimulation zones of the sole of the foot in the region of the zones of the sole of the foot that come into contact on the front and rear face of the foot contact surface, which zones are of particular importance for the biotensegrity system and the effect described above.

It is furthermore proposed that the pimples be of an identical height. The pimples can preferably be of an identical height at least in the new state, in order that the upper faces thereof make up a planar base surface, or in order that they raise a planar base surface by an identical amount. The entire sole of the foot is thus used as a sensory surface, in order to change the biological perception of symmetry, posture, muscle tension, weight distribution and positioning in space, by means of targeted sensory impulses to the entire sole of the foot, such that the person using the footbed experiences an effect that improves posture and gait. However, if stimulation of the foot is useful or advantageous only in a designated region, it would also be conceivable to provide the pimples only in defined portions of the base surface or to emphasize said pimples in specified regions on which the region of the foot to be stimulated comes into contact.

In this case, the pimples can preferably be of a height of from 2 to 3 mm with respect to the foot contact surface, and have a diameter of from 3 to 5 mm, which has been found to be sufficient for bringing about the sensory stimulation effect. In special cases, however, deviations from this standard are expedient.

It is furthermore proposed that it be possible for the diameter of the pimples to be dependent on the shoe size. In this case, the pimples are preferably of smaller diameters and heights in smaller shoe sizes, i.e. for children, than in larger shoes for adults.

It is furthermore proposed that the foot contact surface may comprise at least one functional zone which is raised or depressed relative to the base surface and/or has a greater or lesser hardness than the footbed in the remaining portion. The functional zone makes it possible for the footbed to be individually adapted to a structural and/or functional disorder of the foot, it being possible for the functional zone to be formed only by local raising or depressing, while the remainder of the base surface is formed unchanged as a planar surface.

In this case, the footbed can also have a greater hardness in the region of the functional zone and/or can preferably be formed so as to have a greater hardness by means of a group of pimples of a different hardness with respect to the remaining pimples. The proposed developments make it possible for the stimulation effect, which is intended to be achieved by the pimples or the footbed, to be further intensified locally, in regions of the sole of the foot coming into contact therewith which are defined by the position of the functional zones.

In this case, if necessary, in order to fulfil the purpose thereof, the functional zone may be raised or depressed by 3 to 5 mm, preferably by 4 mm, relative to the base surface. In this case, the functional zones can transition in a harmonious manner, having corresponding radii, into the base surface and continuously rise or lower.

In particular, the functional zone may be formed by a talipes valgus correction surface which is raised relative to the base surface and is arranged in a zone of the foot contact surface on which the foot comes into contact by the inside of the front ball of the foot and the inside of the foot arch. The talipes valgus correction surface protrudes upwards from the base surface and supports the foot on the inside, such that the person's tendency to bend the knees in towards one another is counteracted.

Furthermore, the functional zone may also be formed by a statics correction surface which is raised relative to the base surface and is arranged in a zone of the foot contact surface on which a heel of the foot comes into contact, such that the person's foot is slightly raised at the heel and the foot statics is corrected. It is thus possible to bring about static leg length compensation.

According to a further preferred embodiment, the functional zone is formed by a pes cavus correction surface which is raised relative to the base surface and is arranged in a zone of the foot contact surface on which the entire width of the front foot part of the foot comes into contact. In this case, the pes cavus correction surface can preferably be combined with the statics correction surface, in order to counteract the tendency for pes cavus, because the foot is thereby slightly raised both in the front region and in the region of the heel.

Furthermore, the functional zone may also be formed by a calcaneal spur correction surface which is depressed relative to the base surface and is arranged in a zone of the foot contact surface on which the foot comes into contact by a central portion of the heel thereof and/or by a central portion of the foot arch, as a result of which the load on the foot is purposely relieved in the region of a calcaneal spur.

Furthermore, the functional zone may preferably be formed by a portion which is raised relative to the base surface and is of a lesser hardness than the base surface, which portion is arranged in a zone of the foot contact surface on which a foot comes into contact, on an inside, by a midfoot region that is arranged between a heel and a ball of the foot. The proposed functional zone of the orthopaedic footbed makes it possible for the pumping system of the lymphatic and venous fluids in the human body, referred to in the invention as the "heart of feet function", to be stimulated and intensified. Raising the functional zone, and the lower hardness thereof in the described portion of the foot contact surface means that the stimulation points are stimulated in a targeted manner in this region, the shape of the described functional zone not being purposely adapted to the shape of the foot arch, in contrast with the truss pads known in the prior art, but is instead only raised, since the task of said functional zone is not to support the sole of the foot but instead only to build up pressure more intensively in this region. For this purpose, it is sufficient, for example, for the functional zone to be raised by a constant height in this portion, in contrast with the truss pad.

If present, an anatomical leg length inequality can also take place by means of adapting the material thickness of the orthopaedic footbed on the shortened side. In this case, the material thickness is adapted or increased in particular by adapting the thickness of the base layer located below the stimulation zone.

In this case, the functional zones and the base surface are each formed by uniform, pre-defined, person-independent surfaces, and the various orthopaedic footbeds are formed as a range, having different foot contact surfaces, by means of combining the base surface with different functional zones. The base surface and the functional zones for the different shoe sizes are first designed in a person-independent manner, and are combined to form the foot contact surface of an orthopaedic footbed for a specific foot type. In this case, a different combination of the base surface and the functional zones, or even just using the base surface alone, makes it possible to manufacture different orthopaedic footbeds, having different foot contact surfaces, in a range in large numbers, which footbeds can then be used for different people having different structural problems and/or functional disorders of the feet. Since the footbeds are not manufactured in a person-specific manner, but rather in a range in very large numbers, the production costs and the marketing costs can be significantly reduced by means of the proposed orthopaedic footbed and the method for manufacturing the footbed. Overall, the orthopaedic footbeds can thus be manufactured in a cost-effective manner, for a large number of people, as a result of which it is possible to achieve a significant contribution to improving the health of a large number of people from very wide population strata and in all age groups.

In this case, the footbed can alternatively be formed by a main body onto which the base surface and/or the functional zones are moulded or out of which they are worked. The main body may be a foam block for example, into which both the base surface and the functional zones are for example cut. Alternatively, manufacture in a 3D printing process, a spray process or a sintering process would also be conceivable. Furthermore, the footbed can also be manufactured from different layers of different materials having different properties, in particular different strengths, the layer thicknesses and strengths of which can in turn vary over the foot contact surface, in order to achieve the desired effect that is described in the application.

If the footbed is manufactured from a main body, the functional zones can either be worked into the base surface after manufacture of the base surface, if said functional zones are depressed, or, if they are raised, can already be taken into account during manufacture of the base surface.

Furthermore, in order to achieve the object, a method for providing a footbed that is adapted with respect to a structural and/or functional disorder of a person's foot is proposed, in which method a plurality of different footbeds of a defined size are provided, which footbeds in each case comprise different, modularly assembled, foot contact surfaces, the modular foot contact surfaces of the different footbeds being formed by one of the following pre-defined, person-independent surfaces: a planar base surface or a combination of a planar base surface and a person-independent functional zone that is adapted to a structural and/or functional disorder of the foot, the person being examined for the presence of a structural and/or functional disorder of the foot and, if no structural and/or functional disorder of the foot is present, a footbed of a person-dependent size and comprising a foot contact surface formed by a planar base surface is selected, and, if a structural and/or functional disorder is present, a footbed of a person-dependent size and comprising a foot contact surface formed by a combination of a planar base surface and at least one functional zone is selected.

The footbeds are prefabricated in large numbers and are stored on-site, for example in a shoe shop, a physiotherapy or osteopathy practice, a podiatry practice, a medical practice, a sports shop, a trekking shop, a fitness centre, or a tai-chi training centre, etc. The person is then visually assessed, e.g. by a correspondingly professionally qualified specialist, for the presence of structural and/or functional disorders of the foot, it also being possible, alternatively or in addition, for suitable sensor means, such as pressure-sensitive sensor plates, on which the person stands, to be used as aids. If, in this case, no structural and/or functional disorder of the foot is identified, a footbed comprising a simple, planar base surface is selected, which footbed can also be referred to as a standard footbed. If, in contrast, a structural and/or functional disorder is identified, a footbed that is provided specifically for the structural and/or functional disorder, as a result of the individual functional zone(s), is selected, in a corresponding shoe size.

Figure 2:
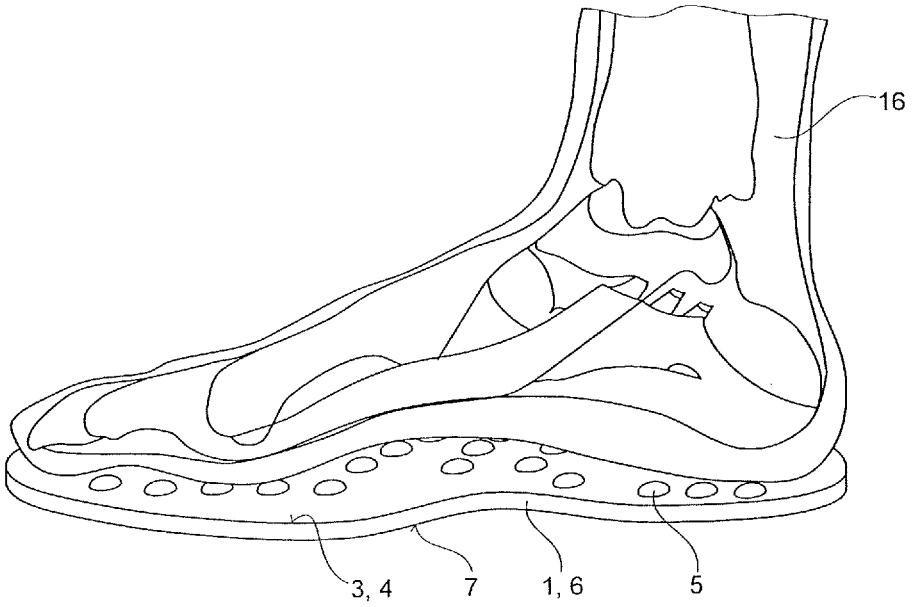
Figure 5:
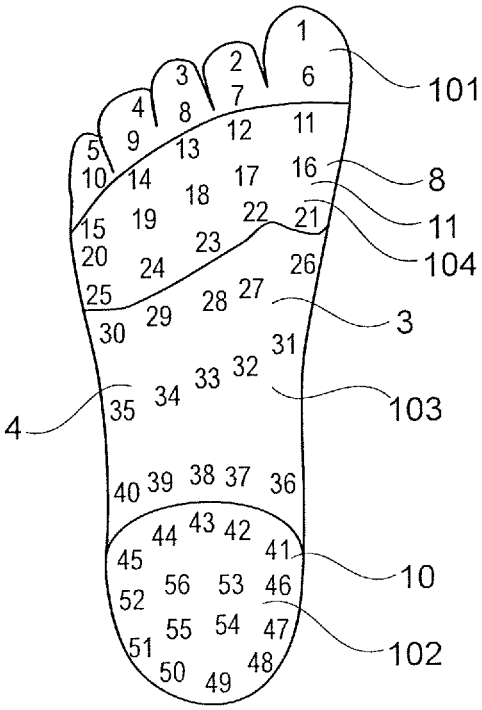
Figure 6:
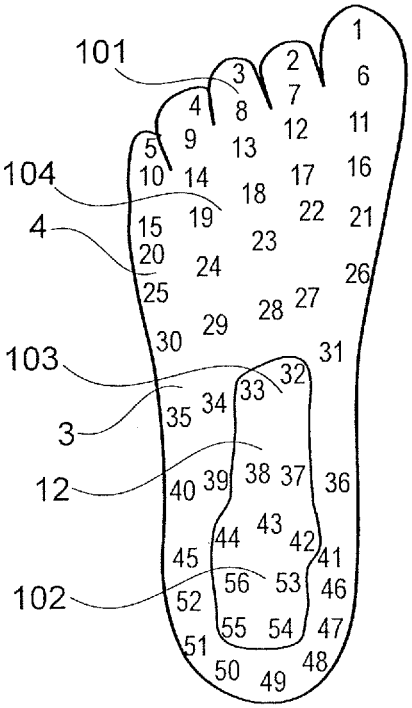
Figure 7:
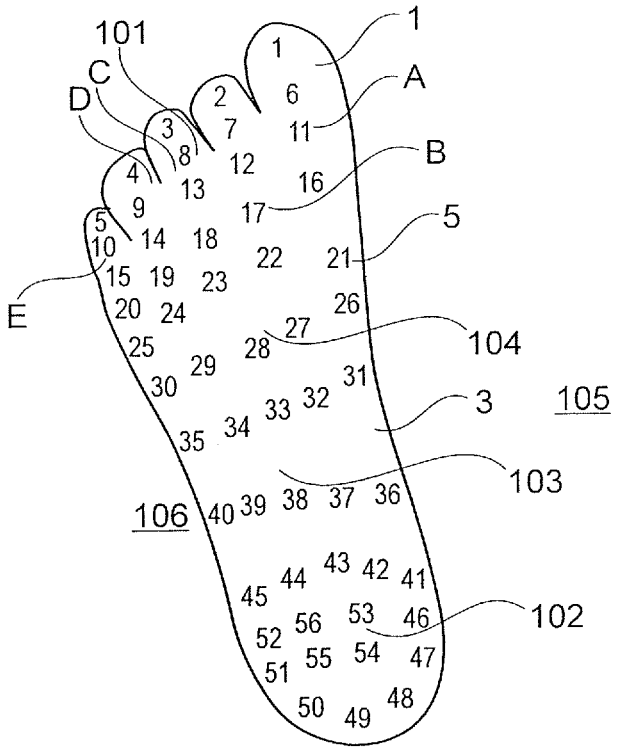
Figure 8:
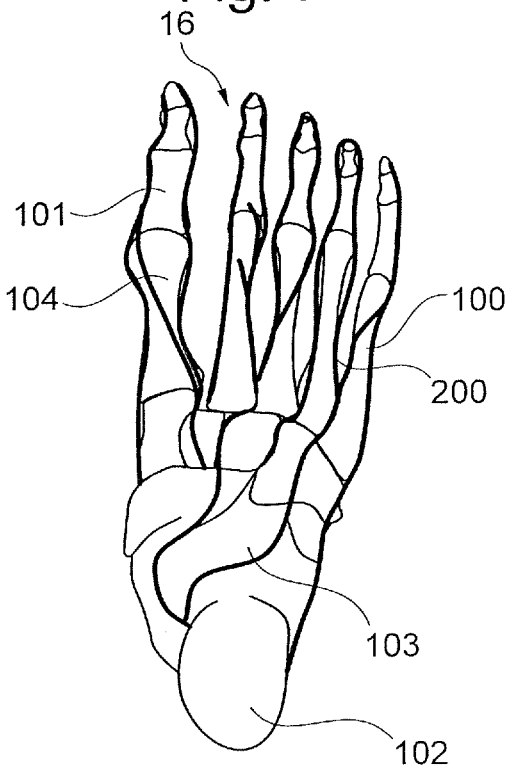
Figure 9:
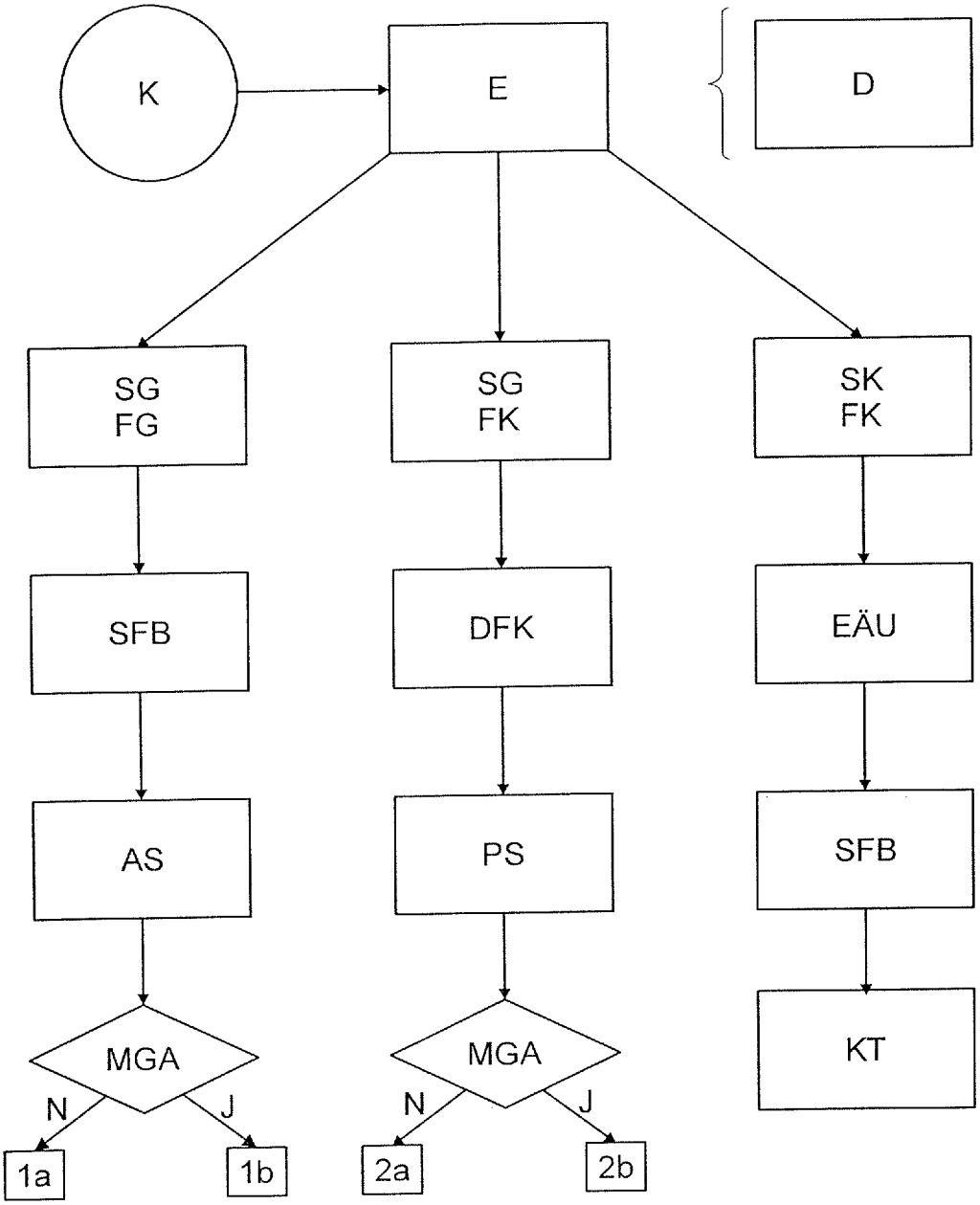
Figure 13:
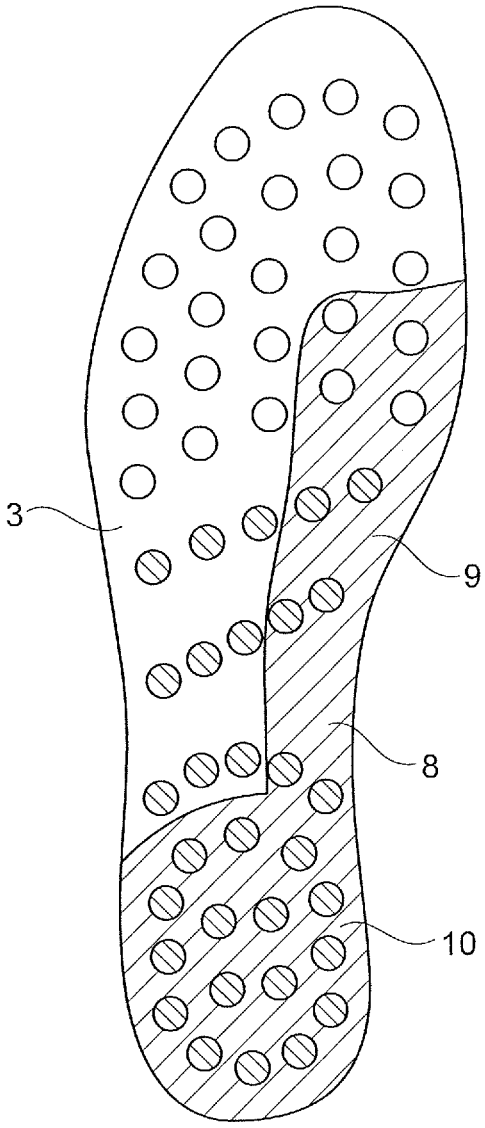
Figure 14:
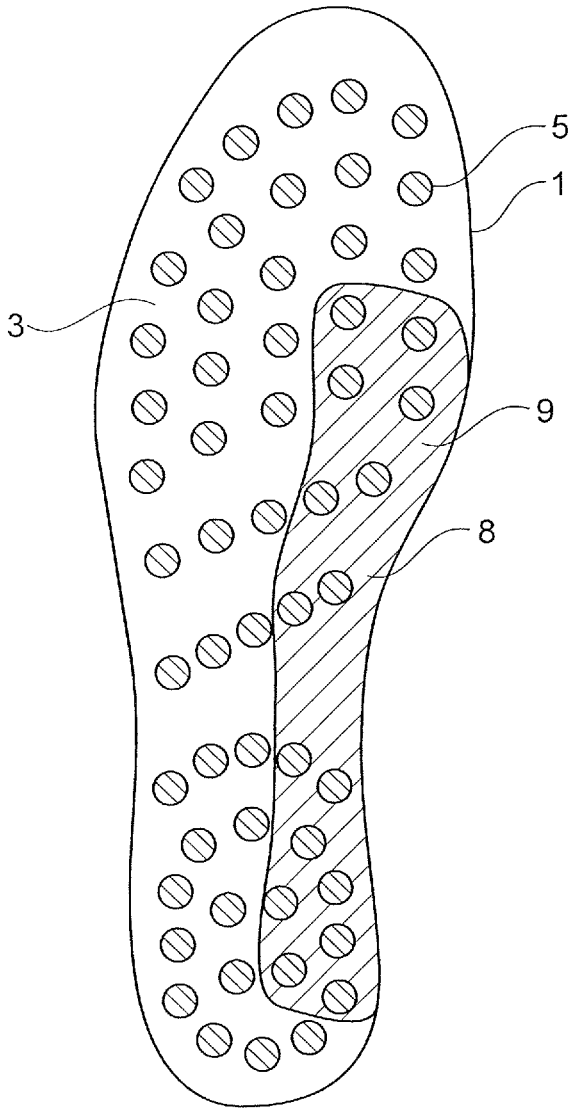
Figure 15:
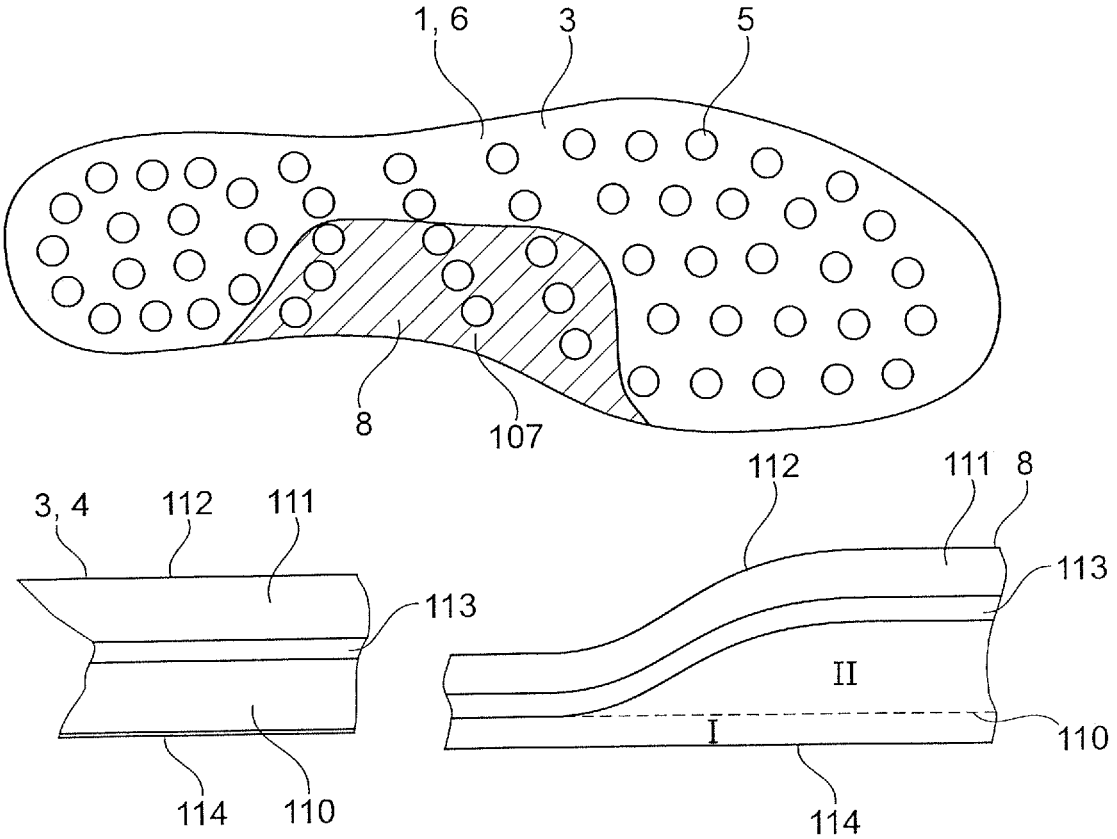

The invention will be explained in the following, on the basis of preferred embodiments and with reference to the accompanying figures, in which:

FIG. 1 is an oblique view of an orthopaedic footbed according to the invention, comprising a planar base surface; and FIG. 2 is a side view of the footbed of FIG. 1; and FIGS. 3 to 6 show various footbeds comprising different functional zones; and FIG. 7 shows an orthopaedic footbed comprising the pimples provided thereon; and FIG. 8 is a view from below of a human foot, showing the bony parts and pathways thereof; and FIG. 9 is a process flow diagram of a method for providing an orthopaedic footbed; and FIGS. 10 to 14 show various footbeds having the distribution according to the invention of the pimples, and functional zones arranged thereon; and FIG. 15 is a view from above, and in two different sectional views, of an orthopaedic footbed according to the invention having a "heart of feet function".

FIG. 1 shows an orthopaedic footbed 1 in the form of an insole 6, which is shown in a side view, having a foot 16 resting thereon, in FIG. 2. The insole 6 comprises a foot contact surface 3 that is formed by a continuous, planar base surface 4 and comprises pimples 5 arranged thereon. The foot contact surface 3 is continuous and planar, and is intended for people having structurally and/or functionally healthy feet. The insole 6 furthermore comprises a planar main surface 7 on the lower face. The insole 6 is thus intended for shoes having a planar inner contact surface. The pimples 5 have an identical height of from 3 to 5 mm, preferably 4 mm, and an identical diameter of from 3 to 5 mm at the foot contact surface 3 or the base surface 4, and the end faces thereof together again form a planar surface to be contacted by the indicated foot 16.

FIG. 7 is a projection from below of the orthopaedic footbed 1, together with the foot 16 shown in FIG. 8 having the bony parts 100 and pathways 200 thereof. If, in the description of the invention, reference is generally made to a foot 16 that is resting on the foot contact surface 3 and that can be identified in FIGS. 2 and 8, it is assumed that the foot 16 is resting on the foot contact surface 3 in accordance with the normal or the pre-determined position.

The reference signs 1 to 56 in each case denote an individual pimple 5 on the orthopaedic footbed 1, and therefore the distribution of the reference signs 1 to 56 corresponds to the distribution of the pimples 5 on the foot contact surface 3. In the basic arrangement thereof, the distribution of the pimples 5 corresponds to the arrangement of the essential bony parts 100 of the bone structure of the foot 16 and the pathways 200 extending thereon, in the projection in the foot contact surface 3 of the orthopaedic footbed 1, as can be easily identified by way of a comparison of FIGS. 7 and 8.

In the basic structure thereof, the foot 16 which can be seen in a view from below in FIG. 8 comprises the bony parts 100 comprising the heel 102, the midfoot 103, the ball of the foot 104, and finally the toes 101. In the event of the person walking with healthy rolling behaviour, said person first puts down the heel 102, and then rolls on over the midfoot 103, the ball of the foot 104 and finally the toes 101. In this case, the heel 102 forms an approximately circular contact region, from which the midfoot 103 extends forwards in the walking direction. Proceeding from the midfoot 103, the bony parts 100 extend further in the form of chains of individual bone members which together form the ball of the foot 104, and the final bone members of the chain form the individual toes 101. The pathways 200 are arranged along the bony parts 100, and the distribution and course of said pathways thus correspond to the distribution and the course of the bony parts 100. The pathways 200 comprise the lymphs and/or the nerves and/or the vessels of the foot 16. In this case, in the basic structure thereof, proceeding from the midfoot 103 the bony parts 100 extend in five bone member chains that are arranged in lines and the individual bone members of which are interconnected by joints.

FIG. 7 shows the orthopaedic footbed 1 comprising the pimples 5 and the various zones on which the relevant bony parts 100 of the foot come into contact, the different zones of the bony parts 100 with which the foot 16 comes into contact on the foot contact surface 3 being denoted by reference signs 101 to 104. The orthopaedic footbed 1 can thus also be considered an anatomical and neurological footbed 1, because it is specifically adapted to the anatomy and neurology of the foot 16 owing to the proposed distribution of the pimples 5. The orthopaedic footbed 1 thus forms a type of "bio-interface" via which the stimulation points in the sole of the foot are stimulated during walking, the proposed distribution of the pimples 5 being of particular significance because, as a result thereof, the walking movement is used for additional stimulation of the stimulation points and the associated improvement of the biotensegrity system. The orthopaedic footbed 1 quasi forms an interface, in the contact surface of the sole of the foot, that is specifically adapted to the stimulation points of the sole of the foot.

In the rear zone of the foot contact surface 3, on which the heel 102 of the foot 16 comes into contact, the pimples 5 are arranged in a circular manner in an imaginary ring, which can be seen from the reference signs 41 to 52. Four further pimples 5, having reference signs 53 to 56, are arranged in the centre of the imaginary ring, in as uniform a distribution as possible and in a square, having identical spacings in the longitudinal direction and transversely to the longitudinal direction of the foot contact surface 3. As a result, at the start of the rolling movement the foot 16 is uniformly stimulated in the stimulation zones of the heel 102, as a result of which the pumping process described at the outset is initiated. In this case, the stimulation signals triggered in the stimulation zones generate corresponding signals, in the person's brain, for pressure change in the associated chambers of the cells or the organs of the person, as a result of which the segmented nervous system and the organs are deliberately vitalized.

During the further rolling movement, a midfoot region 103 of the person's foot 16 rolls on the foot contact surface 3, and in this case rolls over a zone of the foot contact surface 3 in which the pimples 5 are arranged in two imaginary lines that extend transversely to the longitudinal direction of the foot contact surface 3 and diverge towards the inside 105 of the foot contact surface 3, according to reference signs 40 to 36 and 35 to 31. The divergent orientation of the lines means that the spacings of the pimples 5 in the longitudinal direction of the foot contact surface 3 are greater on the inside 105 of the foot contact surface 3 than on the outside 106 of the foot contact surface 3. This arrangement of the pimples 5 is advantageous because the spacings of the stimulation points are smaller on the outside 106 of the foot 16 than on the inside 105. Owing to the divergent orientation, the spacings of the pimples 5 increase in the longitudinal direction of the foot contact surface from the outside 106 to the inside 105, i.e. transversely to the longitudinal direction. Furthermore, the foot arch of the foot 16 is taken into account thereby.

During the further rolling movement, the ball of the foot 104 and the toes 101 of the foot come into contact on the foot contact surface 3 in a zone in which the pimples 5 are arranged in the longitudinal direction of the foot contact surface 3 in five imaginary lines, corresponding to the bony parts 100 of the toes 101. In this case, the pimples 5 are arranged in imaginary lines corresponding to the reference signs 1, 6, 11, 16, 21, 26, the reference signs 2, 7, 12, 17, 22, 27, the reference signs 3, 8, 13, 18, 23, 28, the reference signs 4, 9, 14, 19, 24, 29 and finally corresponding to the reference signs 5, 10, 15, 20, 25, 30. The distribution of the pimples 5 thus corresponds to the representation of the bony parts 100 that form the toes 101, and the pathways 200 arranged along said bony parts, such that in this zone the stimulation points of the toes 101 arranged on the bony parts 100 or the pathways 200 are stimulated in a targeted manner by the pimples 5 during the rolling movement.

The insole 6 shown in FIG. 1 comprises a continuously planar foot contact surface 3 and can also be considered a standard footbed SFB. When viewed from the inner, medial side, the person's foot 16 rests in particular on the heel 102 and the front ball of the foot 104, such that, in the case of a healthy foot, a gap results between the foot arch and the foot contact surface 3 and the foot 16 is deliberately not supported in the region of the foot arch. As a result, the foot 16 is deliberately "stressed", and thus strengthened, in the event of a load, i.e. when standing or walking. Furthermore, the foot 16 experiences sensormotoric stimulation from the pimples 5, as a result of which the muscle control changes and the foot 16 is dynamically strengthened by the tensegrity system that was explained in greater detail at the outset. In addition, the person's venous and lymphatic system is stimulated.

FIGS. 3 to 6 show different variants of the orthopaedic footbed 1 which additionally comprise different raised or strengthened or depressed or weakened functional zones 8, as well as the planar base surface 4. In this case, the functional zones 8 are formed by surfaces which deliberately stimulate the foot 16 by means of their geometry and their arrangement on specific sensor surfaces. For this purpose, the functional zones 8 can either be raised or strengthened to different extents relative to the base surface 4 or can be weakened or depressed relative thereto. The base surface 4 having the standard pimple distribution forms the ideal contact surface for long-term maintenance of the health of the feet in the case of structurally and functionally healthy feet, while the stimulation units in the functional zones 8, which units are modified according to need, supplement or adapt the base surface 4 to form an adapted foot contact surface 3 in order to take account of individual disorders of the structure and/or the function of the feet. In order to simplify comprehension, the foot contact surface 3 of the orthopaedic footbed 1 is divided, in FIGS. 3 to 6, into different points or portions comprising pimples 5 corresponding to reference signs 1 to 56. In these cases, the functional zones 8 are formed by pimples 5 that create increased stimulation in groups and the end faces of which together have an increased contact stimulation effect for specific zones of the foot 16. The increased stimulation effect is generated by zonal hardening or thickening of the EVA base layer 110 that can be seen in FIG. 15, or alternatively by raising particular pimples 5 and the stimulation points formed thereby. Alternatively, the pimples 5 in the functional zones 8 may also be of a greater strength than the pimples 5 in the region of the remaining foot contact surface 3.

Figure 3:
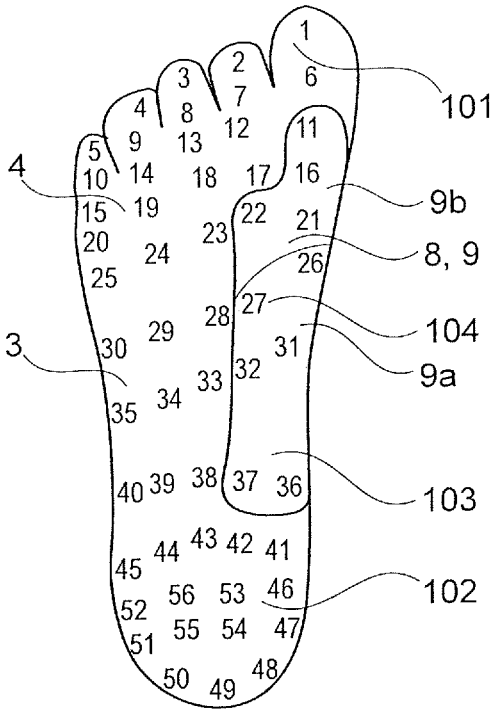

In FIG. 3, the functional zone 8 is formed by a talipes valgus correction surface 9 which is arranged on the foot contact surface 3 such that the foot 16 comes into contact by the inside of the front ball 104 of the foot in points 11, 16, 22 and 21, in a region 9*b*, and by the inside of the foot arch in points 26, 27, 31, 32, 36 and 37, in region 9*a*, of the foot contact surface 3, or is more intensively stimulated in said region. The increased stimulation makes it possible to stimulate counter-control by the central nervous system and to prevent the foot 16 from bending in towards the inside, in the direction of the other foot. Talipes valgus is a functional disorder of the foot 16, in which the person does not step in a straight line with the foot 16, but instead bends the foot in towards the inside, which may subsequently also lead to knock knees and postural abnormalities of the hips and spine.

Figure 4:
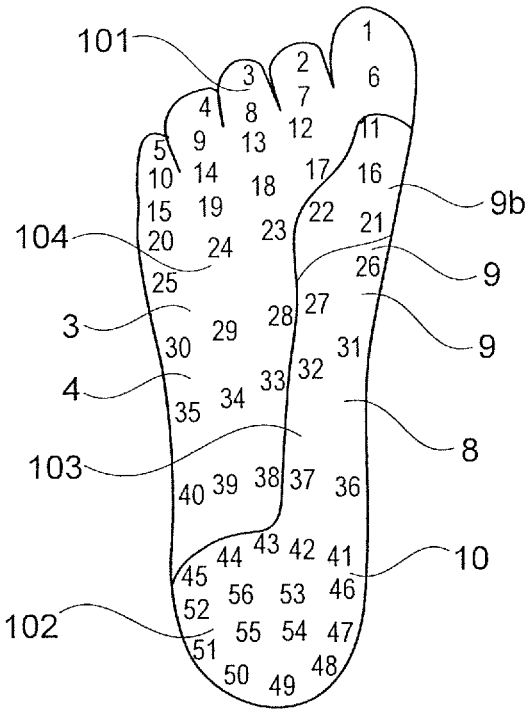

FIG. 4 shows an orthopaedic footbed 1 in which an additional functional zone 8, in the form of a statics correction surface 10, is provided in addition to the talipes valgus correction surface 9. The statics correction surface 10 is formed by raised pimples 5 and the resulting stimulation effect in the foot contact surface 3 in the region of the points 41 to 56, which points form the region on which the person comes into contact with the heel 102. As a result, the stimulation points or pressure receptors in the heel region are stimulated more intensely, such that the statics is adjusted by means of neurological regulation, in the sense of a correction. This is based on the sensormotoric effect of the more intense stimulation, in accordance with the law of the vector addition model.

FIG. 5 shows a further orthopaedic footbed 1 comprising a planar base surface 4 and two functional zones 8. One of the functional zones 8, in the region of the heel 102, is again provided as a statics correction surface 10, and a further functional zone 8 is provided in the region of the front ball of the foot 104, over the entire width of the points 11 to 21, in the form of a pes cavus correction surface 11. Both the statics correction surface 10 and the pes cavus correction surface 11 are in each case functional zones 8 which are raised by 3 to 5 mm with respect to the base surface 4 and which slightly stimulate the person's foot 16 at the heel 102 and in the front foot region, and are formed by stimulation pimples.

FIG. 6 shows a further alternative embodiment of the orthopaedic footbed 1, in which a functional zone 8 in the form of a calcaneal spur correction surface 12 is provided in the base surface 4, which calcaneal spur correction surface is formed by a depression of 3 to 5 mm in the central region of the heel 102 and of the rear, adjoining central portion 103 in the region of points 32, 33, 37, 38, 42, 43, 44 and 53 to 56. The calcaneal spur correction surface 12 is free of pimples, or depressed, relative to the base surface 4, such that the foot 16 is deliberately not stimulated and/or relieved of loading in this region.

The orthopaedic footbed 1 can be designed both as an insole 6 and as a part of a lower shoe. All that is important is that the foot contact surface 3 is correspondingly shaped or that the foot contact surface 1 forms the corresponding foot contact surface 3 in the shoe. In this case, the footbed 1 can in addition comprise a leather coating or textile coating, as a result of which wearing the shoe 2 can be made more comfortable. Furthermore, the footbed 1 should be designed so as to be permanently elastic, breathable, liquid-absorbing and conducting. The resiliency of the footbed 1 should be such that it subjects the foot contact surface 16 to sufficient resistance, the resiliency being intended to allow for slight penetration of the foot 16 into the foot contact surface 3 without the basic distribution of the contact surface, according to the principle, being lost. In particular, the resiliency should be selected such that the foot 16 does not sink in so far as to be in contact over the entire surface thereof, since otherwise the desired loading of the foot 16 is not achieved. This is the case in particular if the foot 16 is structurally and functionally healthy and the foot contact surface 3 is formed only by a planar base surface 4, as is shown in FIGS. 1 and 2. In this case, the foot 16 is intended to be in contact deliberately in a bridged shape, and not to be supported in the region of the foot arch. In this case, the resiliency can be matched, in a targeted manner, to the type of person wearing the shoe 2. It would thus be conceivable, for example, to use a particularly soft footbed 1 specifically for diabetics, and a particularly hard footbed 1 for sportspeople. A possible material would be ethylene vinyl acetate (EVA), for example.

If the orthopaedic footbed 1 is designed as an insole 6, this may be intrinsically resilient, and the functional zones therein may be formed having a greater strength or hardness. In this case, the insole 6 can have a resiliency that is such that said insole can be put into a bag folded, bent back or rolled up, without being damaged in the process. After the insole 6 has been removed from the bag, it unfolds automatically or with slight assistance, owing to the resiliency thereof, back into the original shape, and can thus be inserted into the shoe 2. Simply owing to the greater hardness of the footbed 1 in the region of the functional zones 8, the foot 16 experiences greater support and stimulation here than in the remaining regions of the base surface 4. Furthermore, in addition to the greater hardness thereof, the functional zones 8 can of course also be of a greater height or thickness and optionally comprise additional pimples 5 for stimulation of the sole of the foot.

FIG. 9 shows a flow diagram of a method according to the invention for providing an orthopaedic footbed 1.

Firstly, a range of different orthopaedic footbeds 1 having differently shaped foot contact surfaces 3 for different foot types, in different shoe sizes, shoe last widths and possibly also having different hardnesses, is kept available in a shop or a clinic, in which the people can select and test their orthopaedic footbed 1, which is matched individually to their feed 16, under specialist guidance from correspondingly trained consultants. In this case, the left and right foot 16 may also be different, and therefore different orthopaedic footbeds 1 may be deliberately selected for the left and right foot 16.

Firstly, the customer K is assessed visually and by means of measurements, within the context of an initial assessment E, by the consultant, optionally with the aid of corresponding sensor means such as pressure-sensitive standing surfaces or treadmills. In this case, further aids such as foot and shoe size measurement, a measuring device for measuring the posture and in particular the statics, may be used within the context of a diagnosis D. The consultant then identifies a specific foot type, with or without structural and/or functional disorders and/or with or without impaired statics.

Structurally healthy is denoted in the flow diagram by SG, structural impaired by SK, functionally healthy by FG, and functionally impaired by FK.

Figure 10:
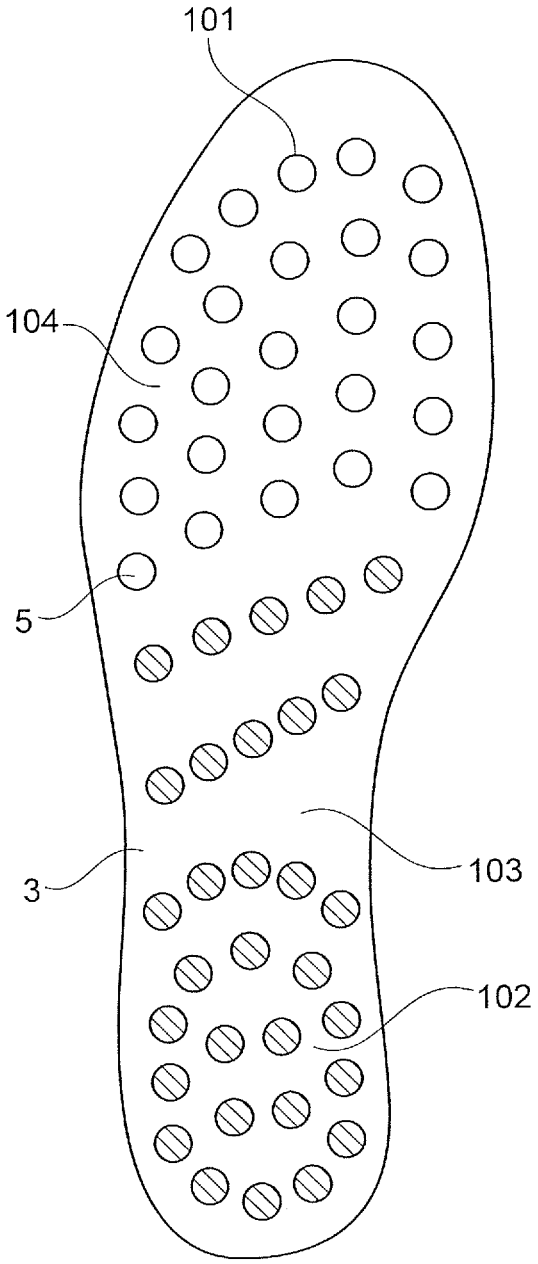

If it is ascertained that the feet are both structurally and functionally healthy SG, FG, it is firstly determined that a standard footbed SFB comprising an orthopaedic footbed 1 having a planar base surface 4 according to FIGS. 1 and 2 and having a distribution of the pimples 5 according to FIG. 10 should be selected. In this case, it is possible inter alia to ascertain that the person has a posture that is slightly bent forward, which is also referred to as anterior statics AS. The slightly bent forward statics, or neutral statics, corresponds to healthy posture and generally does not require any correction, i.e. also does not require a functional zone 8. Subsequently, in a second step, a check is performed as to whether there is medial lowering of the foot arch MGA. If there is no medial lowering, the standard footbed SFB of type 1*a* is selected, which footbed comprises a foot contact surface 3 that is formed by a planar base surface 4 according to FIG. 1 and has a distribution of the pimples 5 according to FIG. 10. If, in contrast, there is medial lowering of this kind, a standard footbed SFB of type 1*b* is selected, in which the planar base surface 4 is supplemented by a functional zone 8 in the form of slight raising by approximately 2 mm or in the form of a portion having a greater hardness in the region 9*a* of the talipes valgus correction surface 9 reduced thereto. The slight medial lowering of the foot arch is considered a functional disorder of the foot 16, it being possible for the tendency of continuing worsening of the disorder to be counteracted by the raising or stiffening in the region 9*a* and the resultant intensification of the stimulation.

If one of the feet 16 is structurally healthy SG and functionally impaired FK, the type of the functional disorder is firstly determined in a further step DFK and a correspondingly individualized orthopaedic footbed 1 comprising a functional zone 8 individually provided for the disorder is selected. A functional disorder of this kind may be talipes valgus for example, the functional zone 8 in this case being the talipes valgus correction surface 9 shown in FIG. 3. Subsequently, a check is performed, in a further step, as to whether posterior statics PS, i.e. backwardly inclined posture of the person, is present in addition. If no posterior statics PS is present, an orthopaedic footbed 1 without a statics correction surface 10 is selected, whereas in the event of posterior statics PS a statics correction surface 10 is added. In a second step, a check is performed as to whether or not there is medial lowering of the foot arch MGA. If this is not present, and the foot 16 at the same time exhibits posterior statics PS, an orthopaedic footbed 1 of type 2*a* is selected, which footbed comprises a foot contact surface 3 which is formed only by the base surface 4 and the statics correction surface 10. If, in contrast, medial lowering of the foot arch MAG is identified, and the foot 16 at the same time exhibits posterior statics PS, the foot contact surface 3 is additionally supplemented to type 2*b*, by stiffening or strengthening of the foot contact surface 3 in the region 9*a* in addition to the statics correction surface 10.

The orthopaedic footbeds 1 shown in FIGS. 5 and 6, comprising the individual foot contact surfaces 3, are further examples of the range of the orthopaedic footbeds 1 which can be selected by assessing or identifying further disorders. It is not impossible for the range of the orthopaedic footbeds 1 to be supplemented by footbeds 1 having differently shaped foot contact surfaces 3 or for further individual functional zones 8 to be developed which can be combined with the base surface 4 and the described functional zones.

If the diagnosis identifies both a structurally impaired SK foot 16 and a functionally impaired FK foot 16, a recommendation is made for a medical examination (EAU), and optionally a recommendation is made for wearing a standard footbed SFB until the results of the medial examination are available. A subsequent follow-up appointment KT may in addition also be arranged.

The advantage of the proposed solution is considered to be that the health of the feet and the posture of a very large number of people can be improved, or the likelihood of the development of disorders and postural defects can be reduced, by means of preventative measures, using simple means basic knowledge of specialists which can be conveyed in specialist seminars for example. In this case, the invention makes use of the advantage that the orthopaedic footbeds 1 are kept available not specifically depending on the individual foot 16, but instead in a person-independent manner for various foot disorders, in the form of a range. The person-specific manufacture of the insoles used hitherto firstly requires production of an individual footprint, on the basis of which the insole is then manufactured. The person could therefore not take the insole immediately, but said insole instead had to be manufactured in an orthopaedics workshop that is specialized in this. As a result, the insole could be collected and worn only after a waiting time of several days or weeks. Overall, providing the insoles was thus associated with corresponding time expenditure and manufacturing outlay, resulting in a drop in the acceptance of wearing insoles. Insoles were worn only if already serious, medically identified disorders of the function and structure of the feet were already present.

According to the method according to the invention for providing the footbed, the orthopaedic footbeds 1 are manufactured in large numbers, having various foot contact surfaces 3 which, although not person-specific, are instead type-specific, i.e. are adapted to the type of the foot 16 by means of the planar base surface 4 or by means of the combination of the base surface 4 with different functional zones 8 that are specially adapted to the structural and functional disorders, and thus allow for significantly more healthy walking. Since the footbeds 1 are tested on-site and can be taken away immediately after being selected, the outlay for obtaining a footbed 1 of this kind is significantly reduced, as a result of which a significantly larger number of people can be convinced to wear footbeds 1 of this kind, at least as a trial. As a result, the health of the population can be significantly improved, on average, by the increased acceptance of orthopaedic footbeds 1, which footbeds can be described as a new biointerface owing to the special distribution of the pimples 5. The distribution of the pimples 5 essentially achieves a biointerface which is used to stimulate the stimulation points of the sole of the foot during walking, and thus to strengthen the biotensegrity system. As a result, the person's normal walking movement itself is used for stimulating the biotensegrity system and for associated improvement of posture and gait.

FIG. 10 shows the orthopaedic footbed 1 according to the invention comprising the pimples 5 provided thereon in a distribution according to the invention, according to FIG. 7, only in this case the pimples 5 are indicated by circles, corresponding to the geometry thereof, instead of by reference signs 1 to 56.

The foot contact surface 3 comprising the pimples 5 provided thereon can be divided, in the same manner, into different regions in which the person comes into contact by the heel 102, the midfoot region 103, the ball of the foot 104 and finally with the toes 101 of the foot 16.

Figure 11:
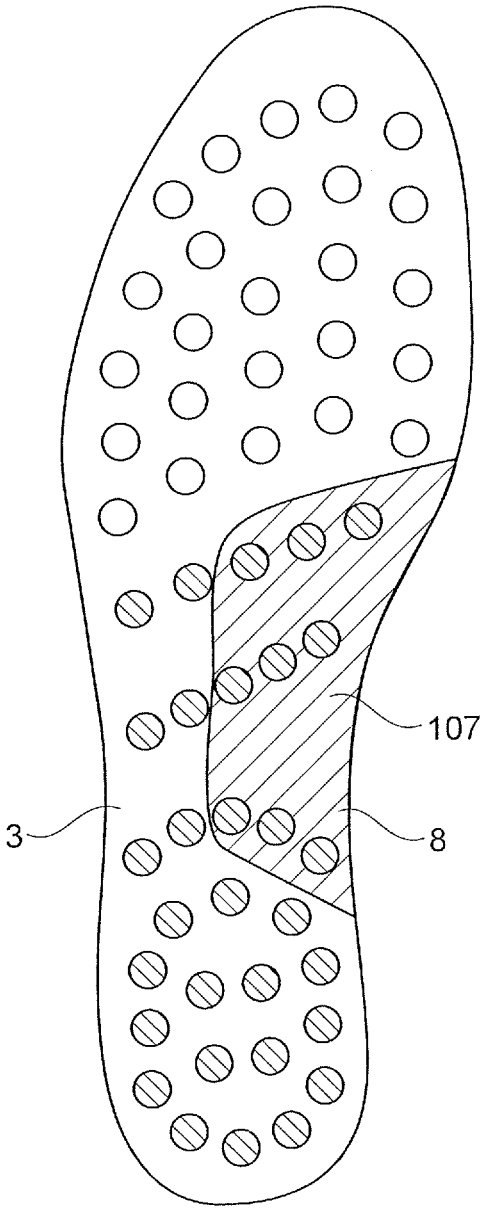

FIG. 11 shows the orthopaedic footbed 1 comprising an additional functional zone 8 in the form of a portion 107 of the central region 103 on the inside 105 that is at a higher level but is of a lower hardness. In this case, the portion 107 having the lower hardness can be achieved by a raised design of the base surface 4, such that the pimples 5 arranged thereon stimulate the stimulation points, in the portion of the sole of the foot coming into contact therewith, earlier and rather more firmly, during walking. The proposed functional zone 8, formed by the higher portion 107, makes it possible for the pumping system of the sole of the foot, for the lymphatic and venous fluids, to be particularly strengthened, and therefore the footbed 1 shown in FIG. 11 is preferably advantageous for people having lymphatic and/or venous insufficiency. The proposed variant of the orthopaedic footbed 1 shown in FIG. 11 makes it possible for the "heart of feet function" of the sole of the foot to be stimulated and intensified. In principle, any variant of the orthopaedic footbed 1 can be provided with the "heart of feet function" for optimizing the lymphatic and venous fluid transport, by means of providing the functional zone 8 in the portion 107.

Figure 12:
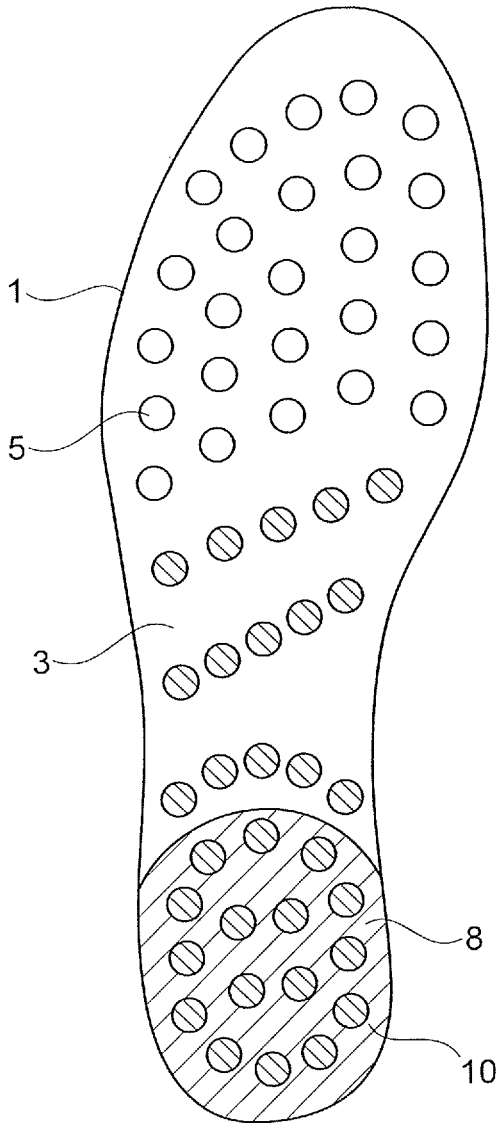

FIG. 12 shows a further orthopaedic footbed 1 comprising a statics correction surface 10 which, in the embodiment of FIG. 13, is supplemented by a functional zone 8 in the form of a talipes valgus correction surface 9. Both the statics correction surface 10 and the talipes valgus correction surface 9 are formed by portions of the footbed 1 having a greater hardness, which portions can be formed either by a portion of the base surface 4 having a greater hardness or by pimples 5 having a greater hardness that are arranged in said portions, or by a combination of a base surface 4 having a greater hardness in said portions and pimples 5 having a greater hardness.

Both locally arranging pimples 5 having a greater hardness, and forming the base surface 4 so as to have a greater hardness and/or so as to be at a higher level locally result in the desired local stimulation effect on the sole of the foot being intensified. As a result, both the gait and the posture of the person can be positively influenced and corrected, since the perception in the sole of the foot leads to a postural change, in accordance with what is known as the vector addition model.

FIG. 14 shows the orthopaedic footbed 1 comprising a functional zone 8 formed by the talipes valgus correction surface 9, which functional zone is specifically intended for a foot 16 having neutral statics and an unstable medial foot arch.

Furthermore, FIG. 15 again shows the orthopaedic footbed 1 having a distribution of the pimples 5 corresponding to the embodiment of FIG. 11, for intensifying the above-described "heart of feet function". The bottom drawing shows the structure of the footbed, in a cross section through the base surface 4, on the left-hand side, and in a cross section through the base surface 4 that is raised relative to the functional surface 8, on the right-hand side.

In the base surface 4, the orthopaedic footbed 1 comprises an EVA base layer 110 and an EVA cover layer 111 which are separated from one another by a stimulation layer 113. The EVA base layer 110 is covered, on the lower face, by a carrier layer 114, and the EVA cover layer 111 is covered, on the top face, by a functional tissue layer 112 having fluid-conducting and breathable properties, which layer simultaneously forms the foot contact surface 3. The EVA base layer 110, the EVA cover layer 111, the stimulation layer 113, the functional tissue layer 112, and the carrier layer 114 each have a constant thickness, such that the orthopaedic footbed 1 has a constant thickness in the region of the base surface 4, apart from the pimples 5 (not visible) which are arranged thereon.

In the right-hand drawing, the EVA base layer 110 is of a greater thickness, in order to form the functional zone 8, while the thickness of the remaining layers is constant. The raising of the foot contact surface 3 in the region of the functional zone 8 is thus achieved merely by increasing the thickness in the EVA base layer 110. The thickening of the EVA base layer 110 is shown in the right-hand drawing, by the zone II of the EVA base layer 110 in the region of the functional zone 8, above the zone I.

The functional tissue layer 112 is preferably formed by a breathable and fluid-permeable textile material, while the carrier layer 114 is formed by a wear-resistant plastics material, for example having a carbon effect.

Both the EVA cover layer 111 and the EVA base layer 110 are manufactured from an EVA material, and virtually form the volume material of the footbed 1. The stimulation layer 113 is manufactured from a hard plastics material and defines the hardness of the footbed 1.

The "heart of feet function" brought about by the orthopaedic footbed 1 according to the invention will be explained again, in greater detail, in the following.

The sole of the foot is a blood and lymphatic pump and assists the return transport of the blood supplied by the heart. This return transport is brought about by the muscle-vein pump in the foot, formed by the vessels, the fasciae system, the bones and the muscles, together with gravity.

Owing to the particular anatomical structure comprising the tissues encased in fasciae, natural movements and the pressure changes in the foot that are induced or stimulated by the footbed 1 according to the invention result in fluid-displacement effects owing to the constant change in tissue pressure gradients. When compressed and elongated, the pressure on the tissue portions protruding into the fasciae-encased chambers is significant, the alternating peaks and troughs of the pressure build-up brings about a pumping mechanism which is weakened but still present in the case of impaired venous and lymphatic vessels.

The theory of the pumping movement in the sole of the feet of people can be explained as follows: The basis of the pumping movement is a grille having pressure gradients that are generated by deformation: Upon stretching, the pressure in the enclosed chambers increases owing to the movement of the connective tissue fasciae lines, and pressurized movement of the fluid takes place in a manner channelled from the foot to the centre of the body. If the movement of the grille recedes, the pressure gradient reduces again, resulting in fluid collecting in the chambers, between the grille elements. These movements alternate cyclically, as a result of which the body transports lymphatic and venous fluid from the narrowest tissue gaps to the heart, outside of vessels and in the smallest of vessels.

The fasciae lines around each cell are thus inter alia also a person's "other heart", which represents and is therefore responsible for the centripetal pumping movement, in the way in which the heart represents a large portion of the centrifugal pumping movement.

The material of the "heart of feet" zone of the orthopaedic footbed 1 according to the invention, in portion 107 of FIG. 15, should be made up in the following manner: For example a 5-15 mm high, soft material layer may be provided, which layer is arranged between the EVA base layer 110 and the stimulation layer 113, or alternatively optionally also between the stimulation layer 113 and the EVA cover layer 111, in the region marked in the drawing. In this case, the additional material layer is represented by the region II. The material is sufficiently soft to not support the foot, but robust enough to compress the connective tissue of the foot from the skin, via the subcutaneous adipose tissue, as far as the vascular region and the muscles of the longitudinal foot arch, in which some of the venous and lymphatic vessels are located. Silicones, EVA materials, or other similarly functioning soft and permanently elastic materials, exhibiting a soft restoring force and quick return to the original shape following the relevant deformation with each step, are used as materials for said functional zone.

The pressure increase results in expulsion of at least 20 to 40 cubic centimetres of blood and lymphs from the foot back towards the heart with each tread. Increasing the pressure relative to the orthopaedic footbed 1 without a "heart of feet" function significantly assists the venous and lymphatic return flow to the heart, in order to assist the insufficient, i.e. weakly pumping, venous and lymphatic vessels of the foot in their natural function.

The invention claimed is:

1. An orthopaedic footbed for a shoe, comprising:

a foot contact surface, wherein the foot contact surface is formed by a planar base surface having a plurality of pimples that is arranged in accordance with a distribution of the plurality of pimples that is optimized for podiatry, wherein the distribution of the plurality of pimples that is optimized for podiatry corresponds to:

a distribution such that when a user wears the shoe, the distribution corresponds to an anatomical distribution, projected in the foot contact surface, of bony parts of a human foot of the user that comes into contact with the foot contact surface, wherein the plurality of pimples is arranged in a zone of the foot contact surface on which the human foot comes into contact by a front ball of the foot of the human foot, in five rows, corresponding to:

orientation of bony parts that form toes of the human foot, wherein the plurality of pimples is arranged in a circular manner in a zone of the foot contact surface on which a heel of the human foot comes into contact, and wherein the plurality of pimples is arranged in a zone of the foot contact surface on which a midfoot region of the human foot comes into contact, in at least two lines that diverge towards an inside of the foot contact surface, wherein the inside of the foot contact surface is a side of the foot contact surface that is assigned to an inside of the human foot resting thereon.

2. The orthopaedic footbed according to claim 1, wherein spacings between pimples of the plurality of pimples reduce, in a longitudinal direction of the foot contact surface, proceeding from a zone of the foot contact surface on which a midfoot region of the human foot comes into contact, to a front and/or rear face of the foot contact surface.

3. The orthopaedic footbed according to claim 1, wherein the pimples of the plurality of pimples are of an identical height.

4. The orthopaedic footbed according to claim 1, wherein the pimples of the plurality of pimples is of a height of from 2 to 3 mm with respect to the foot contact surface.

5. The orthopaedic footbed according to claim 1, wherein the pimples of the plurality of pimples have a diameter of from 3 to 5 mm.

6. The orthopaedic footbed according to claim 1, wherein the insole has a resiliency that is such that said insole can be folded and/or shaped into another shape, in a non-destructive manner, via pressure application, and said insole returns automatically to an original shape thereof when the pressure is relieved.

7. The orthopaedic footbed according to claim 1, wherein the foot contact surface comprises at least one functional zone which is raised or depressed relative to planar base surface of the foot contact surface and/or has a greater or lesser hardness than the orthopaedic footbed in a remaining portion.

8. The orthopaedic footbed according to claim 7, wherein the at least one functional zone is formed so as to have a greater hardness via a group of pimples of the plurality of pimples having a different hardness with respect to the remaining pimples of the plurality of pimples.

9. The orthopaedic footbed according to either claim 7, wherein the at least one functional zone is raised or depressed by 3 to 5 mm relative to the planar base surface.

10. The orthopaedic footbed according to claim 7, wherein the at least one functional zone is formed by a talipes valgus correction surface which is raised relative to the planar base surface and is arranged in a zone of the foot contact surface on which the human foot comes into contact by a front ball of the foot of the human foot and a foot arch of the human foot.

11. The orthopaedic footbed according to claim 7, wherein the at least one functional zone is formed by a statics correction surface which is raised relative to the planar base surface and is arranged in a zone of the foot contact surface on which the human foot comes into contact by the heel of the human foot.

12. The orthopaedic footbed according to claim 7, wherein the at least one functional zone is formed by a pes cavus correction surface which is raised relative to the planar base surface and is arranged in a zone of the foot contact surface on which an entire width of the front foot part of the human foot comes into contact.

13. The orthopaedic footbed according to claim 7, wherein the at least one functional zone is formed by a calcaneal spur correction surface which is depressed relative to the planar base surface and is arranged in a zone of the foot contact surface on which the human foot comes into contact by a central portion of the heel of the human foot thereof and/or by a central region of the foot arch of the human foot.

14. The orthopaedic footbed according to claim 7, wherein the at least one functional zone is formed by a portion which is raised relative to the planar base surface and is of a lesser hardness than the planar base surface, which portion is arranged in a zone of the foot contact surface on which the human foot comes into contact, on the inside of the foot contact surface by a midfoot region of the human foot that is arranged between a heel of the human foot and a ball of the human foot.

15. A set of orthopaedic footbeds, comprising:

a plurality of orthopaedic footbeds, wherein each orthopaedic footbed of the plurality of orthopaedic footbeds is an orthopaedic footbed in accordance with claim 7, wherein, for each orthopaedic footbed of the plurality of orthopaedic footbeds, the at least one functional zone and the planar base surface are in each case formed by uniform, pre-defined, person-independent surfaces, and wherein the orthopaedic footbeds of the plurality of orthopaedic footbeds are formed as a range of different orthopaedic footbeds each having different foot contact surfaces via a combination of the planer base surface and different at least one functional zones.

16. A method for providing an orthopaedic footbed that is adapted with respect to a structural and/or functional disorder of a foot of a person, comprising:

providing a plurality of different orthopaedic footbeds, wherein each orthopaedic footbed of the plurality of different orthopaedic footbeds is an orthopaedic footbed in accordance with claim 1, wherein each orthopaedic footbed of the plurality of different orthopaedic footbeds is of a defined size, which orthopaedic footbeds in each case comprise different, modularly assembled, foot contact surfaces, wherein the modular foot contact surfaces of the different orthopaedic footbeds are formed by one of the following pre-defined, person-independent surfaces:

a planar base surface, or a combination of a planar base surface and a person-independent functional zone that is adapted to a structural and/or functional disorder of the foot, and examining the person for the presence of a structural and/or functional disorder of the foot, and, if no structural and/or functional disorder (SK, FK) of the foot is present, an orthopaedic footbed of a person-dependent size and comprising a foot contact surface formed by a planar base surface is selected, and if a structural and/or functional disorder (SK, FK) is present, an orthopaedic footbed of a person-dependent size and comprising a foot contact surface formed by a combination of a planar base surface and at least one functional zone is selected.

17. The method according to claim 16, wherein in that the person is examined for the presence of a structural and/or functional disorder (SK, FK) of the foot using a suitable sensor means.

18. The method according to either claim 16, wherein the person is examined for the presence of a structural and/or functional disorder (SK, FK) of the foot using suitable visually identifiable criteria.

* * * * *